US008308579B2

(12) United States Patent
Qiu

(10) Patent No.: US 8,308,579 B2
(45) Date of Patent: Nov. 13, 2012

(54) SUSPENSION DEVICE FOR ELECTRIC SWING AND ELECTRIC SWING COMPRISING THE SAME

(76) Inventor: Bingshun Qiu, Xiamen (CN)

( * ) Notice: Subject to any disclaimer, the term of this patent is extended or adjusted under 35 U.S.C. 154(b) by 0 days.

(21) Appl. No.: 13/304,684

(22) Filed: Nov. 27, 2011

(65) Prior Publication Data

US 2012/0071253 A1 Mar. 22, 2012

Related U.S. Application Data

(63) Continuation of application No. PCT/CN2010/000723, filed on May 25, 2010.

(30) Foreign Application Priority Data

May 27, 2009 (CN) ..... 2009 1 0145362

(51) Int. Cl.
*A63G 9/16* (2006.01)
*A63G 9/00* (2006.01)

(52) U.S. Cl. ..... 472/119; 472/125

(58) Field of Classification Search ..... 472/118–125; 297/273, 274
See application file for complete search history.

(56) References Cited

U.S. PATENT DOCUMENTS 3,842,450 A * 10/1974 Pad ..... 5/109
4,491,317 A * 1/1985 Bansal ..... 472/119
5,833,545 A * 11/1998 Pinch et al. ..... 472/119
5,960,488 A * 10/1999 Morris ..... 4/496
6,908,398 B1 * 6/2005 Kang ..... 472/119

FOREIGN PATENT DOCUMENTS

JP 06339578 A * 12/1994

* cited by examiner

*Primary Examiner* — Kien Nguyen
(74) *Attorney, Agent, or Firm* — Matthias Scholl P.C.; Matthias Scholl

(57) ABSTRACT

A suspension device for an electric swing including a supporting bracket, a supporting beam, a suspended swing stem, a swing push rod, a gear motor, an electromagnetic clutch, a torque output plate, a direction switching pendulum weight, a swing direction monitor, a safety switch, and a microcomputer controller. The shaft of the gear motor is fixedly connected with the electromagnetic clutch. Two end surfaces of the electromagnetic clutch are fixedly provided with two rigid pins clamped at two sides of the torque output plate. The torque output plate pushes the direction switching pendulum weight. The direction switching pendulum weight pushes the swing push rod and the swing push rod pushes the suspended swing stem and the suspended body to swing. The gear motor and the electromagnetic clutch are electrically connected with the microcomputer controller. The device has a simple structure, reliable and silent operation, and is easy to carry.

14 Claims, 15 Drawing Sheets

SUSPENSION DEVICE FOR ELECTRIC SWING AND ELECTRIC SWING COMPRISING THE SAME

CROSS-REFERENCE TO RELATED APPLICATIONS

This application is a continuation of International Patent Application No. PCT/CN2010/000723 with an international filing date of May 25, 2010, designating the United States, now pending, and further claims priority benefits to Chinese Patent Application No. 200910145362.9 filed May 27, 2009. The contents of all of the aforementioned applications, including any intervening amendments thereto, are incorporated herein by reference.

BACKGROUND OF THE INVENTION

1. Field of the Invention

The invention relates to the category of leisure products, and more particularly to a suspension device for an electric swing and an electric swing comprising the same. The device can be used for cradles, hammocks, and other fields that need the automatic swing device.

2. Description of the Related Art

Conventional automatic swings have disadvantages of complicated structure and limited application scope. Therefore, more improvements are required in the aspects of simplified structure, reliable operation, energy saving, silent operation, easy to carry, and wide application in different fields etc. Conventionally, a motor used for driving a suspension swing device to swing is a gear motor, with work process as follows: a suspended body (swing) is pushed manually to swing—a motor is energized—the motor pushes the suspended body (swing)—the motor is switched off—the suspended body (swing) swings forward based on inertia—the suspended body (swing) swings backward and pushes the motor in turn—the motor is reenergized—repeat the above process. Such structure is simple and reliable but has an obvious drawback. That is, the motor does not rotate in a circle, instead, it rotates forward—the motor is switched off—the motor is pushed to rotate in a reversed direction—and it continues to work in another cycle. In such case, only a few teeth of the gear work rather than the whole gear works evenly, which affects the service life of the motor.

SUMMARY OF THE INVENTION

In view of above-described problems, it is one objective of the invention to provide a suspension device for an electric swing. The suspension device for an electric swing features a simple and compact structure, reliable and silent operation, energy saving, and is easy to carry.

To achieve the above-described objective, in accordance with one embodiment of the invention, there provided is a suspension device for an electric swing comprising:

a) a supporting beam;
b) a supporting bracket;
c) a suspended body;
d) a suspended swing stem;
e) a gear motor;
f) an electromagnetic clutch;
g) a torque output plate;
h) a swing push rod;
i) a swing direction monitor;
j) a safety switch; and
k) a microcomputer controller;

wherein the supporting beam, the supporting bracket, and the suspended swing stem cooperate to bear the suspended body;

the suspended swing stem is connected with the supporting beam via a ball bearing or via a ball bearing on an suspended plate fixedly mounted on the supporting beam;

the bottom of the suspended swing stem is mechanically connected with the suspended body;

the gear motor is mechanically connected with a mounting plate fixedly arranged on the supporting beam;

the electromagnetic clutch is mechanically connected with the gear motor;

the torque output plate is flexibly coupled with the electromagnetic clutch;

the direction switching pendulum weight is mechanically connected with the mounting plate;

the swing direction monitor is coupled with a bearing of the suspended swing stem or a shaft of the suspended swing stem;

the swing push rod is mechanically connected with at least two suspended swing stems;

the microcomputer controller is electrically connected with the swing direction monitor, the gear motor, and the electromagnetic clutch; and the microcomputer controller controls the turn on/off of a power supply of the gear motor and the electromagnetic clutch.

In a class of this embodiment, the gear motor is a worm gear motor or a gear reducer motor.

In a class of this embodiment, the electromagnetic clutch comprises a disc-shaped armature and a cylindrical electromagnetic clutch body; the disc-shaped armature is fixedly connected with the gear motor; the electromagnetic clutch body is closely against the armature and a ball bearing at the center of the electromagnetic clutch body is fixedly connected with a shaft of the gear motor; the ball bearing at the center of the electromagnetic clutch body has the function of enabling the electromagnetic clutch body to rotate relatively with the shaft of the gear motor and the armature when the electromagnetic clutch body is not powered; and two rigid pins are fixedly arranged in the axial direction along the diameter edge of the electromagnetic clutch body in the opposite of the armature.

In a class of this embodiment, the torque output plate is a metal plate capable of bearing the output torque of the gear motor and a shaft fixedly connected with the torque output plate is sheathed with an elastic rubber jacket, which provides a buffering effect and reduces the noise when the direction switching pendulum weight is pushed.

In a class of this embodiment, a screw in the center of the torque output plate is loosely connected with the center of the shaft of the gear motor; the torque output plate has a width smaller than the distance (approx. ⅕-⅛) between the two rigid pins on the electromagnetic clutch body and has a length larger than the distance between the two rigid pins; the two rigid pins on the electromagnetic clutch body are clamped at the two sides of the torque output plate and each of the two rigid pins is sheathed with an elastic rubber jacket, which provides a buffering effect and reduces the noise when the torque output plate is pushed.

In a class of this embodiment, a bearing seat of the direction switching pendulum weight is fixedly connected with the mounting plate; the direction switching pendulum weight is fixedly connected with the bearing seat via a ball bearing or a rolling bearing; the direction switching pendulum weight is fixedly connected with a shaft and the shaft is sheathed with an elastic rubber jacket, which provides a buffering effect and reduces the noise when the swing push rod is pushed.

In a class of this embodiment, the ball bearing of the suspended swing stem is fixedly connected with a hole of the suspended swing stem and the supporting beam, respectively.

In a class of this embodiment, the swing push rod is connected with a plurality of suspended swing stems; a bearing seat is fixedly connected with the swing push rod at the opposite position of the direction switching pendulum weight and the bearing seat is mounted with a ball bearing or a rolling bearing.

In a class of this embodiment, the swing direction monitor comprises a rotating ring, a damping ring, a friction ring, a photoelectric shield, a shield baffle, a photoelectric switch, and a bracket of the photoelectric switch.

In a class of this embodiment, the rotating ring is fixedly connected with the outer ring of the ball bearing on the suspended swing stem; a gap is formed between the rotating ring and the supporting beam; the rotating ring rotates around the outer ring of the ball bearing; the external diameter of the rotating ring is sheathed with the damping ring, which is made of high polymer materials; the damping ring is sheathed with the friction ring having the photoelectric shield fixedly connected therewith; within the turning radius of the photoelectric shield, the bracket of the photoelectric switch is fixed on the supporting beam, and the bracket is equipped with the photoelectric switch and the shield baffle; the photoelectric shield works at an enclosed space formed between transmitting/receiving members of the photoelectric switch and the shield baffle; and the swing of the photoelectric shield controls the turn on/off of the photoelectric switch.

In a class of this embodiment, the safety switch is mounted in a casing and can be touched when the swing range of the suspended swing stem exceeds a safety limit thereof.

In a class of this embodiment, the microcomputer controller comprises a microprocessor, a signal input port, a power input port, a wireless signal receiver module, and a time-controlled energy output port; the gear motor, the electromagnetic clutch, the photoelectric switch, and the safety switch are electrically connected with the microcomputer controller.

In a class of this embodiment, the signal input port receives the control signals sent by the photoelectric switch, panel buttons, and the wireless signal receiver module and then input them into the microprocessor; the microprocessor will calculate the optimum time control based on the input data from the signal input port and control the turn on/off of a power supply of the gear motor and the electromagnetic clutch via the time-controlled energy output port.

In another aspect, the invention provides an electric swing comprising the suspension device and a swing seat. The swing seat comprises a suspension rod, a backrest, a seat, armrests and a foot pad; the suspension rod and the armrests are coupled with the suspended swing stem, the backrest, the seat, and the foot pad to form the swing seat. The supporting bracket is H-shaped and comprises an upstanding column, a curved column, a longitudinal reinforced tube, and a transverse reinforced tube. The supporting beam is fixedly connected with the supporting bracket. The central portion of the supporting beam is arranged with a mounting plate with the suspension device for an electric swing mounted thereon. The suspended swing stem is fixedly connected with the supporting beam via a ball bearing.

Advantages of the invention are summarized below: the gear motor costs less and operates stably without noise; the electromagnetic clutch is employed and thus the drawback of the gear motor of being pushed reversely is solved; the direction switching pendulum weight narrows the excessively huge housing caused by the fact that the shaft of the gear motor axially forms an angle of 90° with the output shaft of the worm reducer and thus achieves a beautiful appearance; the whole device has the advantages of compact structure, reliable operation, and wide applications, and it is also energy saving and easy to carry.

DETAILED DESCRIPTION OF THE EMBODIMENTS

Figure 1:
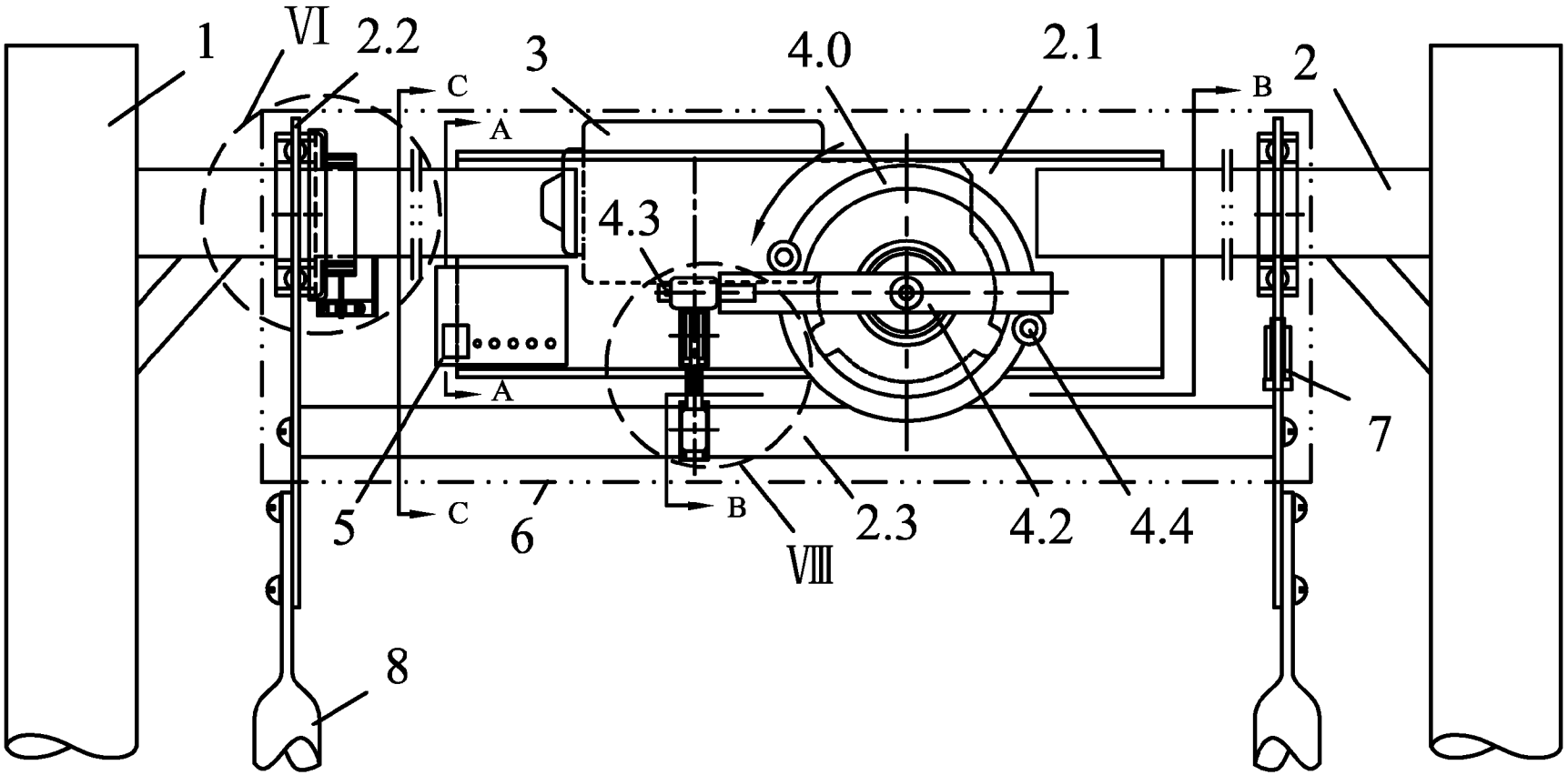
FIG. 1 is a front view of a suspension device for an electric swing in accordance with one embodiment of the invention.
Figure 2:
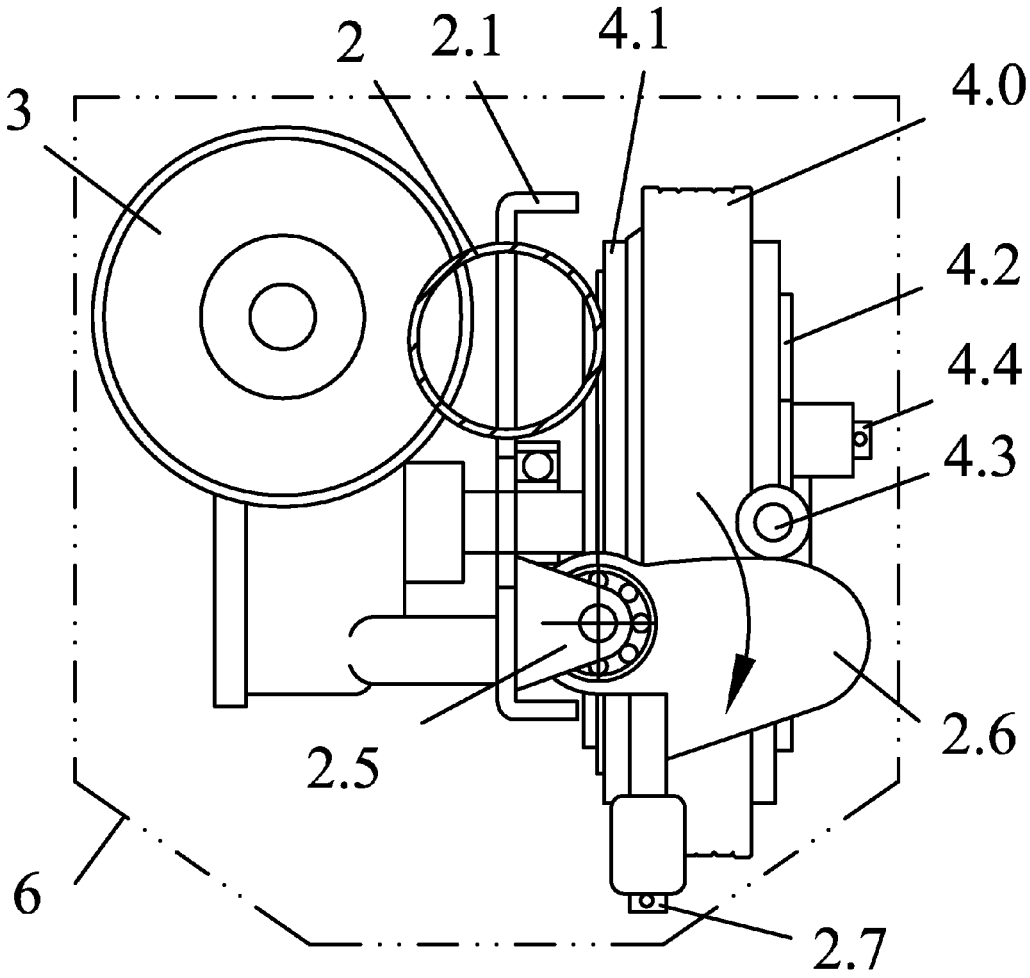
FIG. 2 is a sectional view of the suspension device for an electric swing of FIG. 1 taken from line A-A in accordance with one embodiment of the invention.
Figure 3:
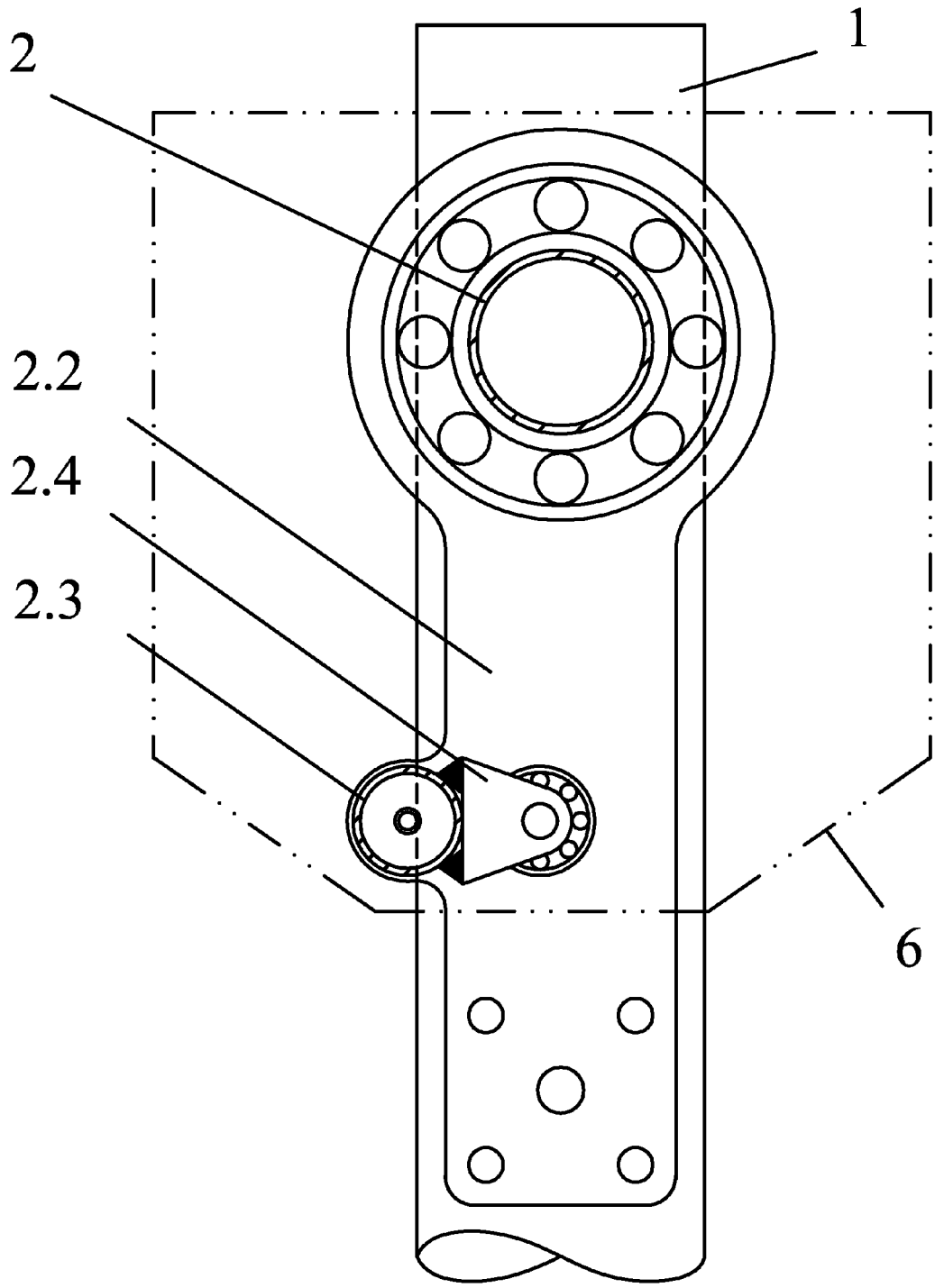
FIG. 3 is a sectional view of the suspension device for an electric swing of FIG. 1 taken from line B-B in accordance with one embodiment of the invention.
Figure 4:
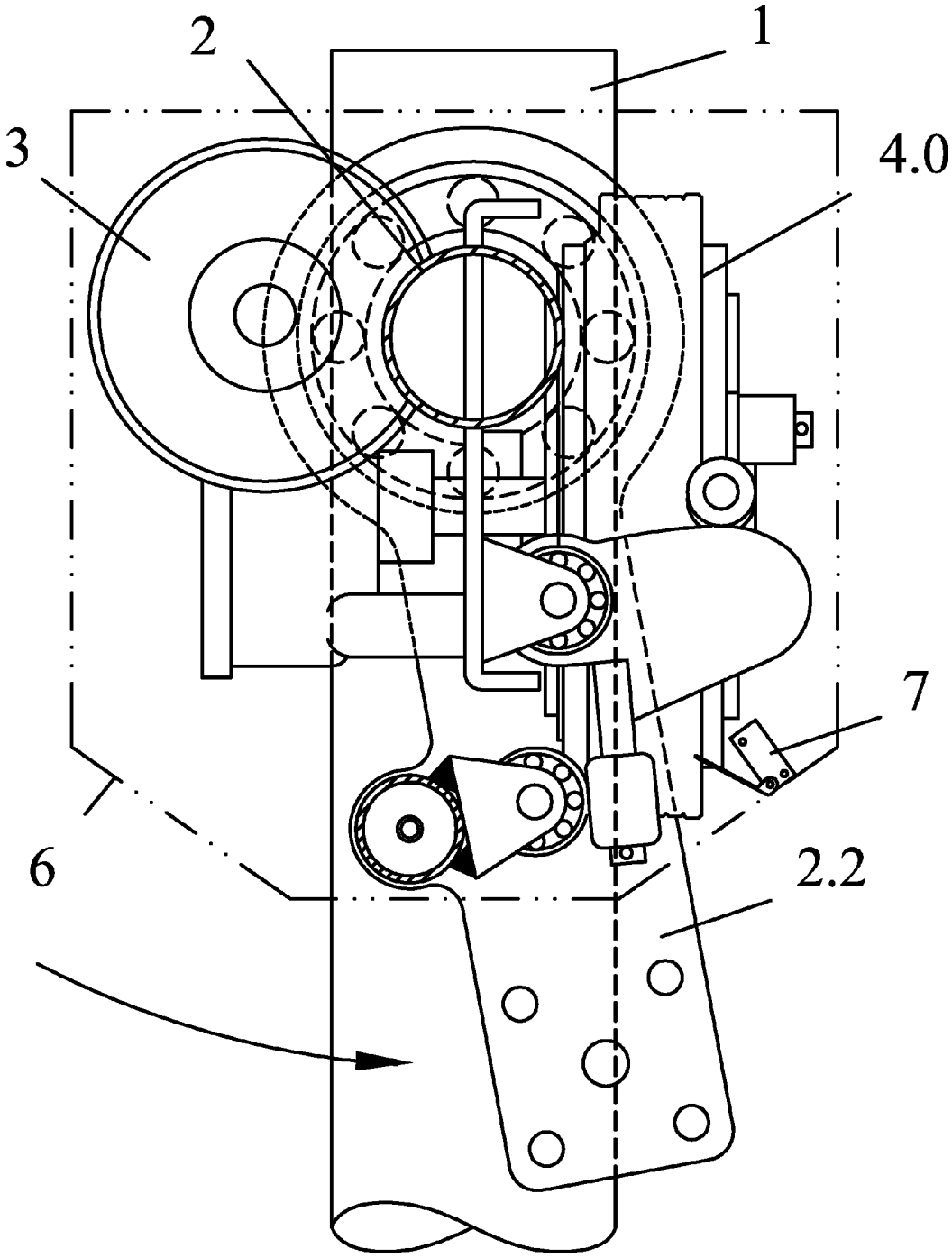
FIG. 4 is a first sectional view of the suspension device for an electric swing of FIG. 1 taken from line C-C in accordance with one embodiment of the invention.
Figure 5:
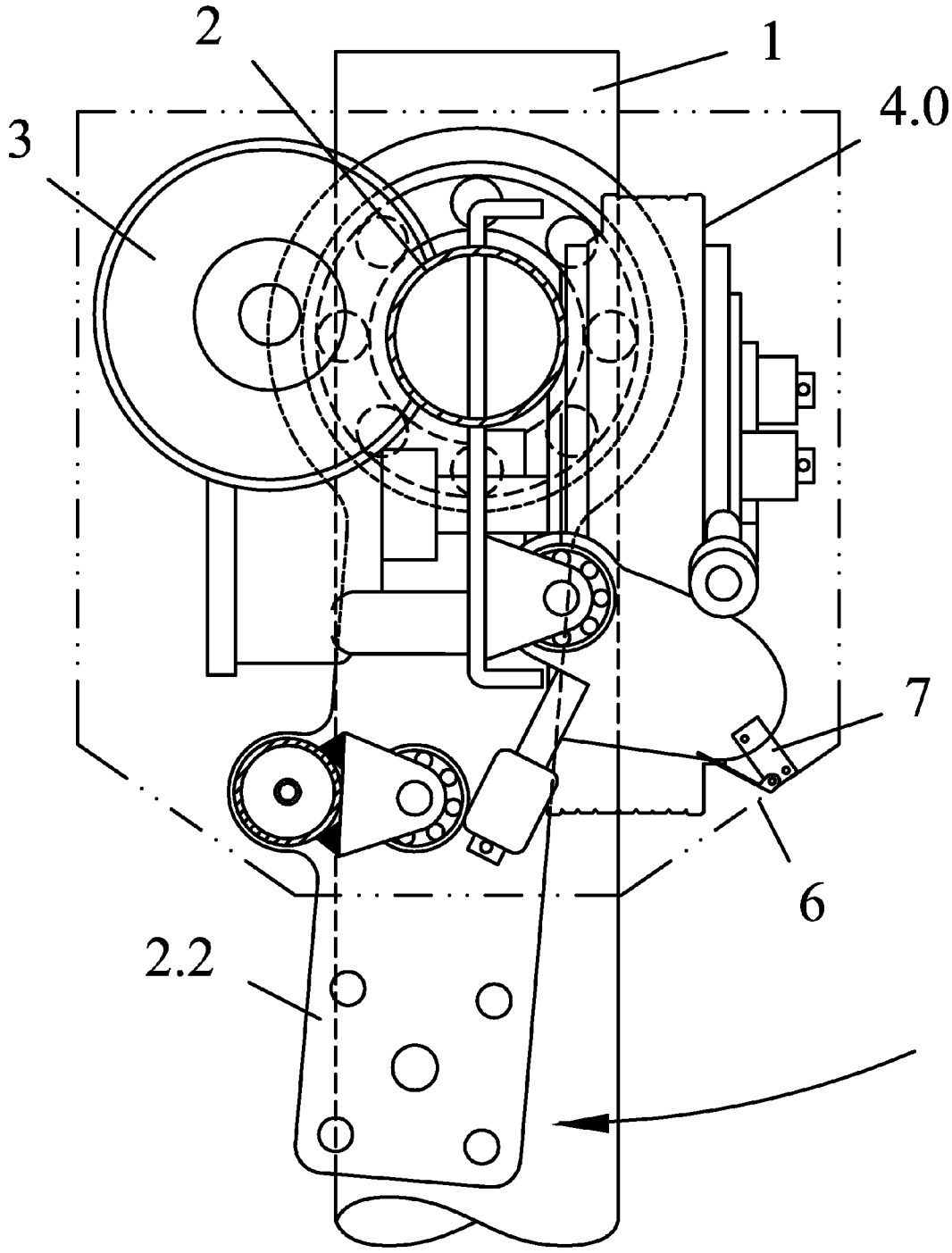
FIG. 5 is a second sectional view of the suspension device for an electric swing of FIG. 1 taken from line C-C in accordance with one embodiment of the invention.
Figure 6:
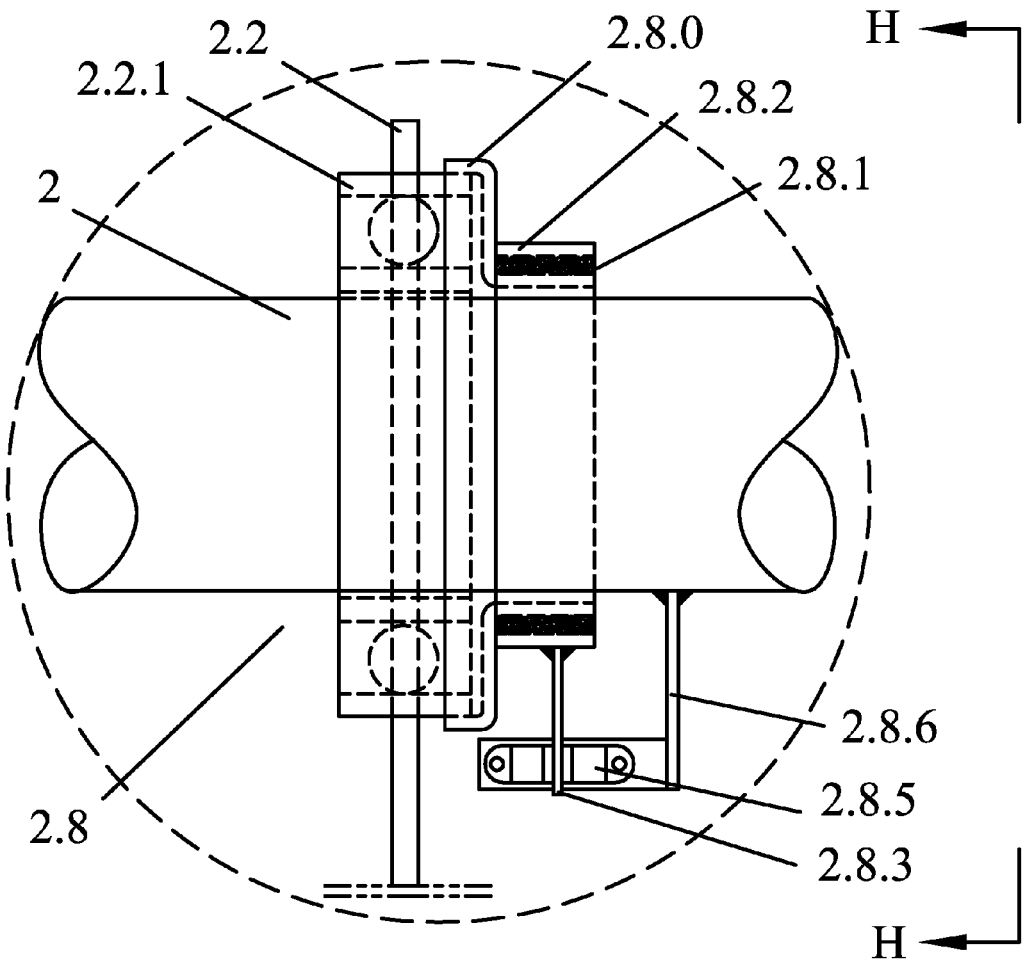
FIG. 6 is an enlarged view of a swing direction monitor VI of the suspension device for an electric swing of FIG. 1 in accordance with the one embodiment of the invention.
Figure 7:
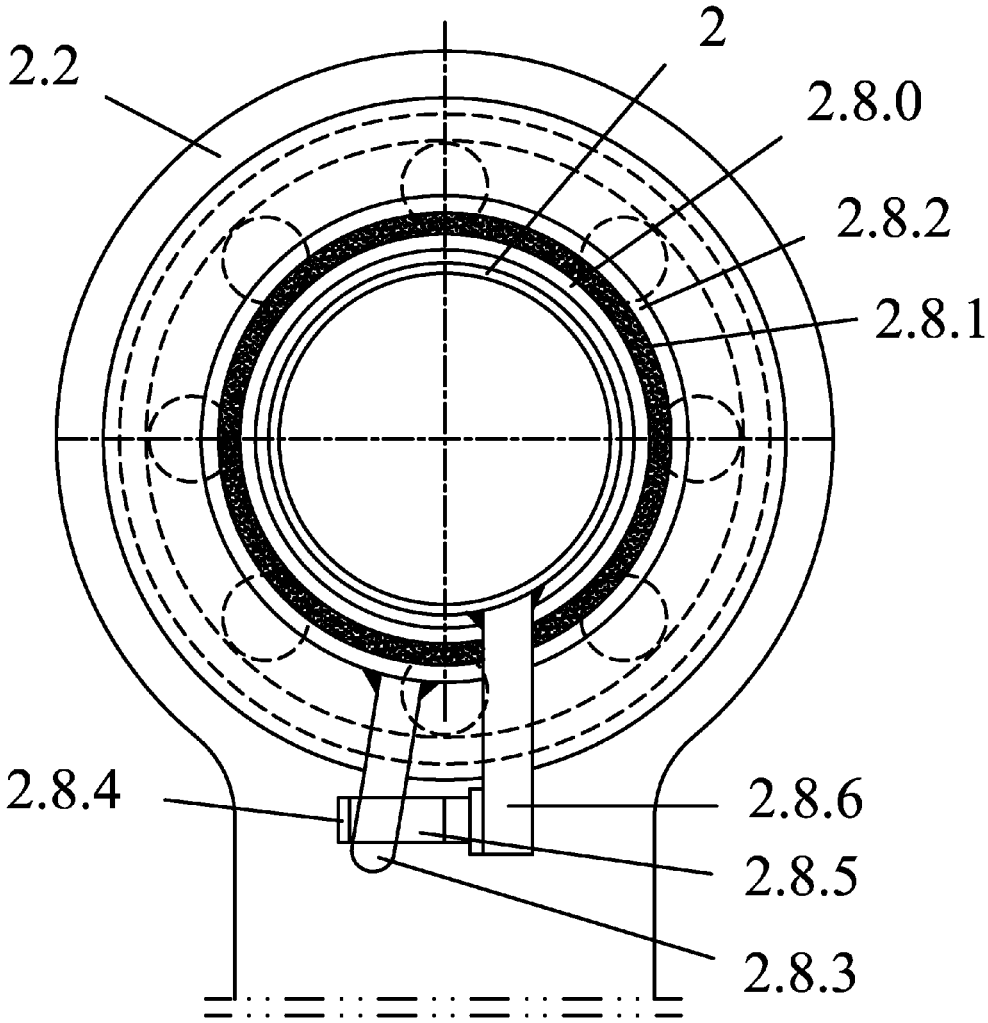
FIG. 7 is a sectional view of the suspension device for an electric swing of FIG. 6 taken from line H-H in accordance with the one embodiment of the invention.
Figure 8:
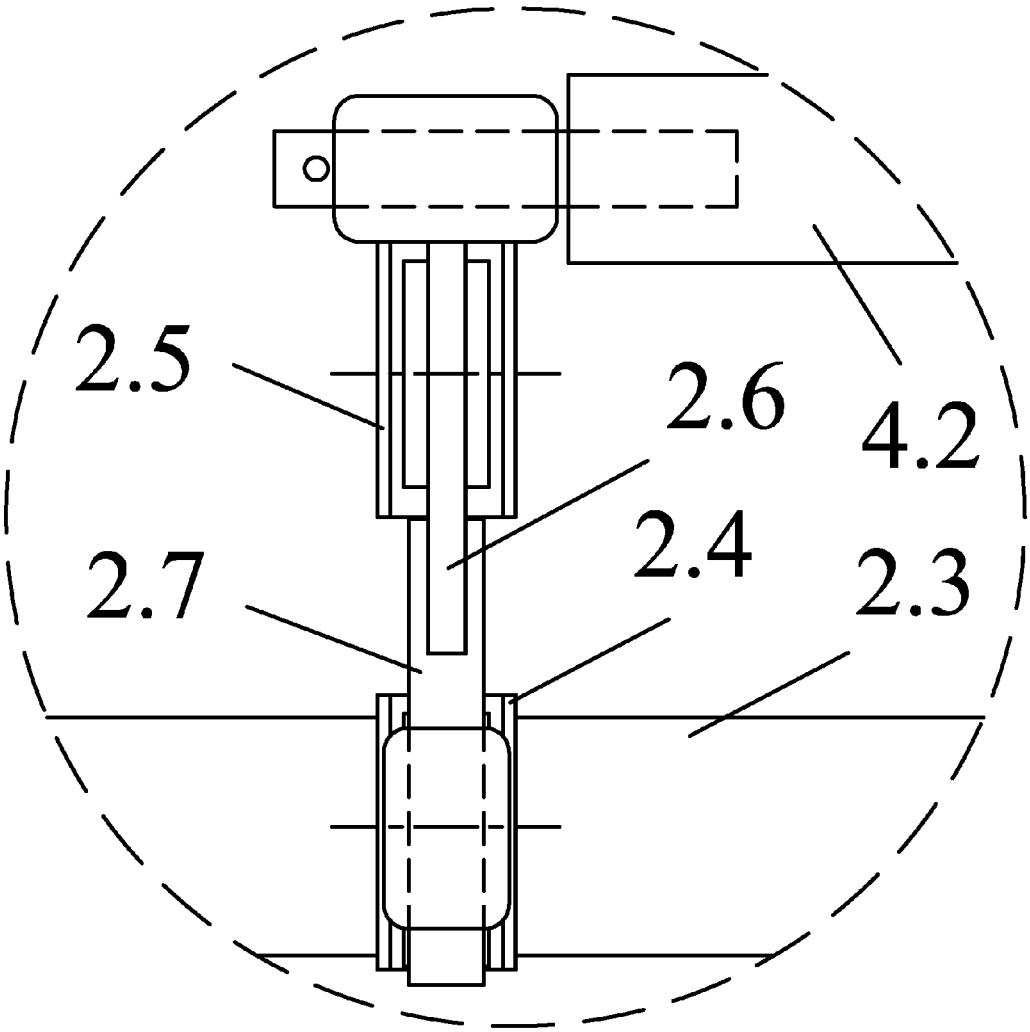
FIG. 8 is an enlarged view of section VIII of the suspension device for an electric swing of FIG. 1 in accordance with the one embodiment of the invention.
Figure 9:
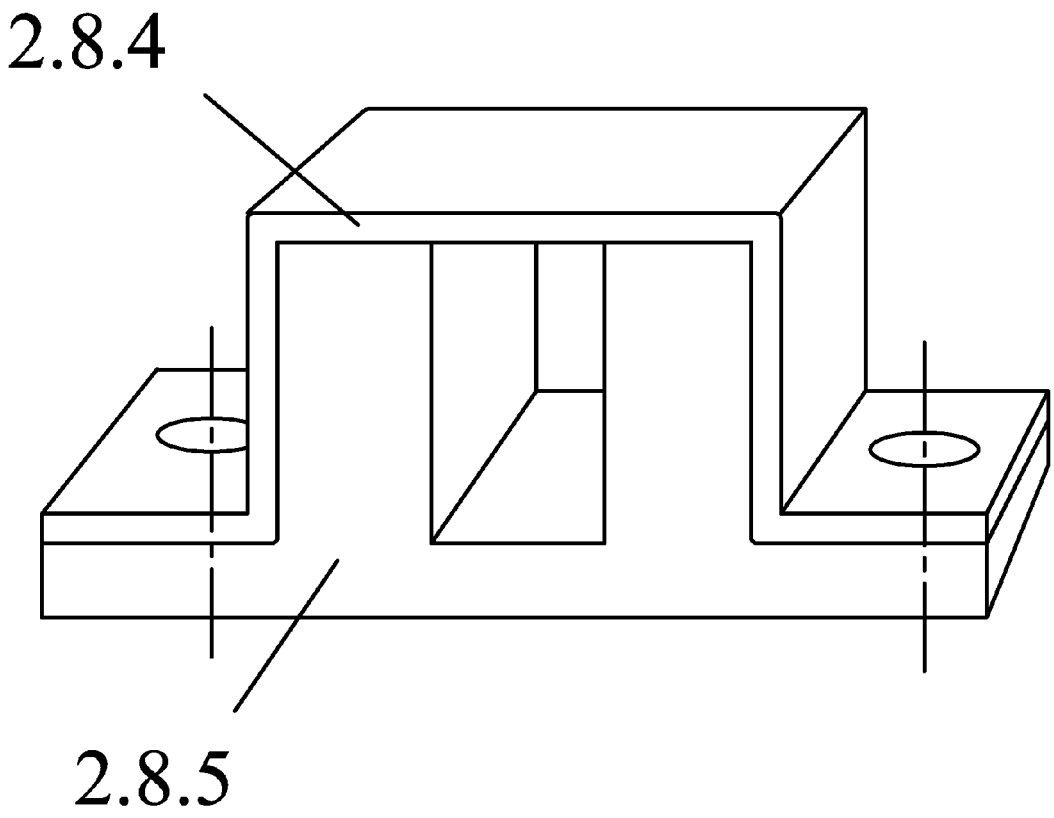
FIG. 9 is a three-dimensional view of a photoelectric switch and a baffle shield of a suspension device for an electric swing in accordance with one embodiment of the invention.
Figure 10:
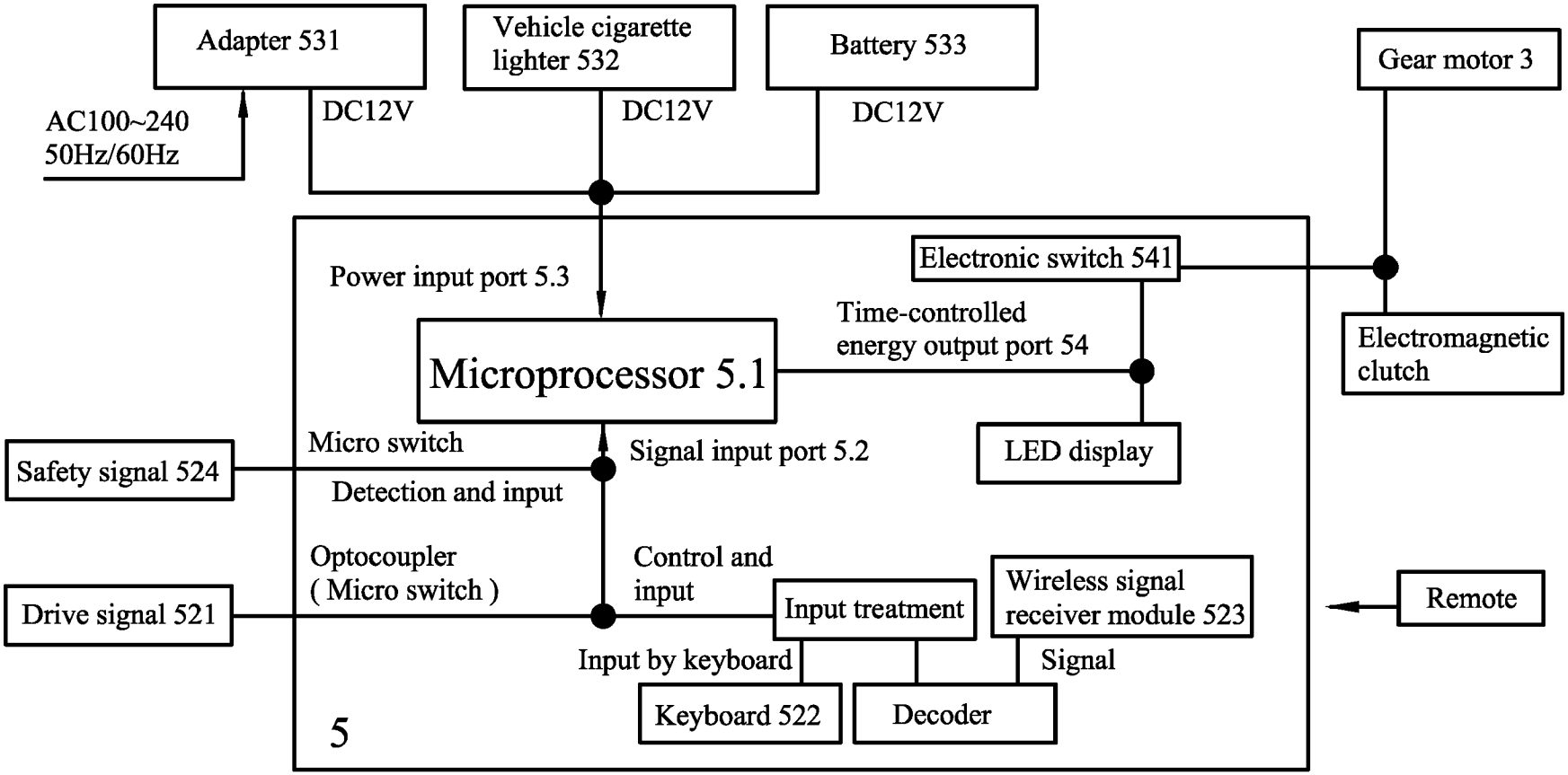
FIG. 10 is a block diagram of a microcomputer controller of a suspension device for an electric swing in accordance with one embodiment of the invention.
Figure 11:
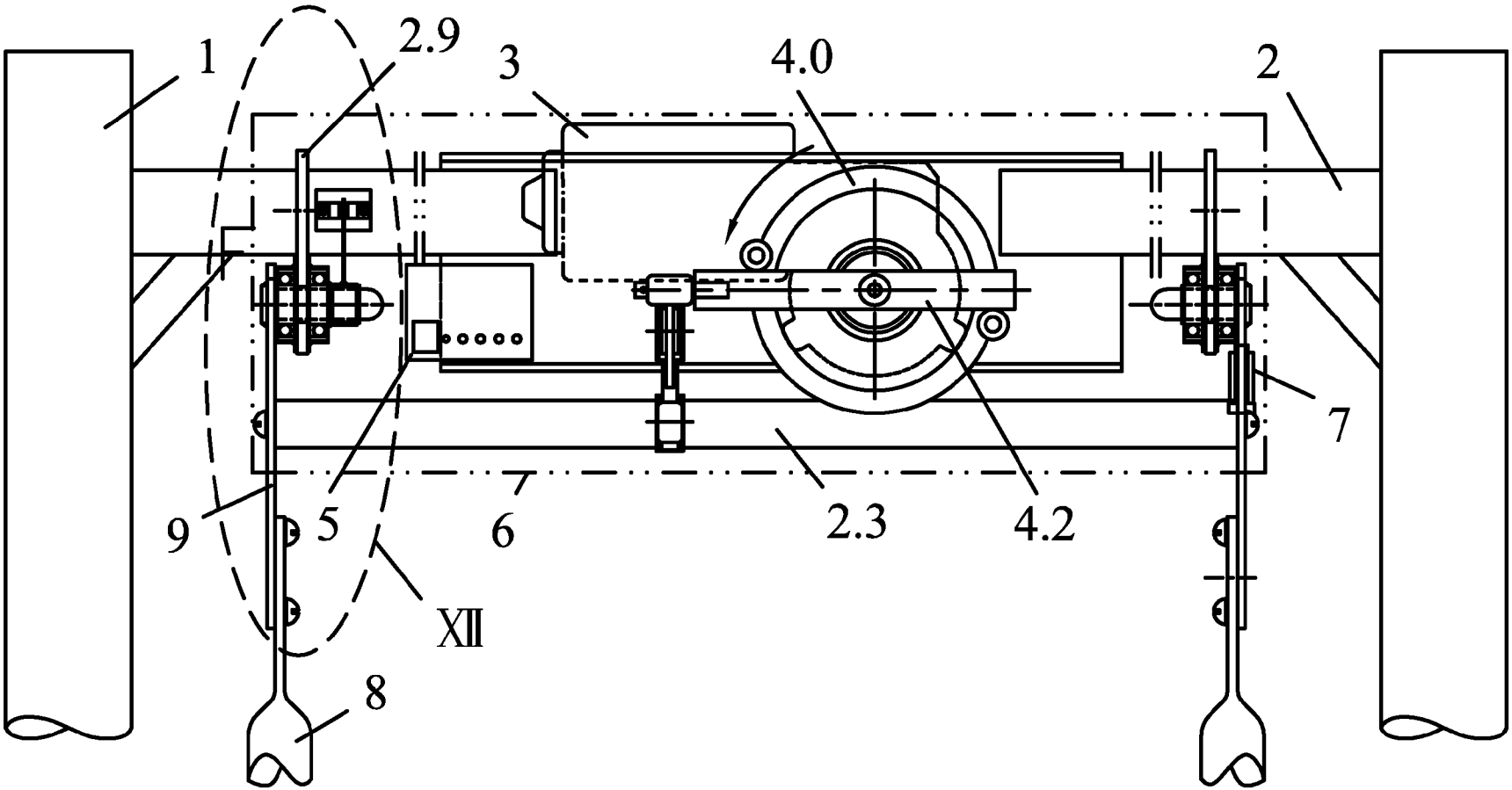
FIG. 11 is a front view of a suspension device for an electric swing in accordance with another embodiment of the invention.
Figure 12:
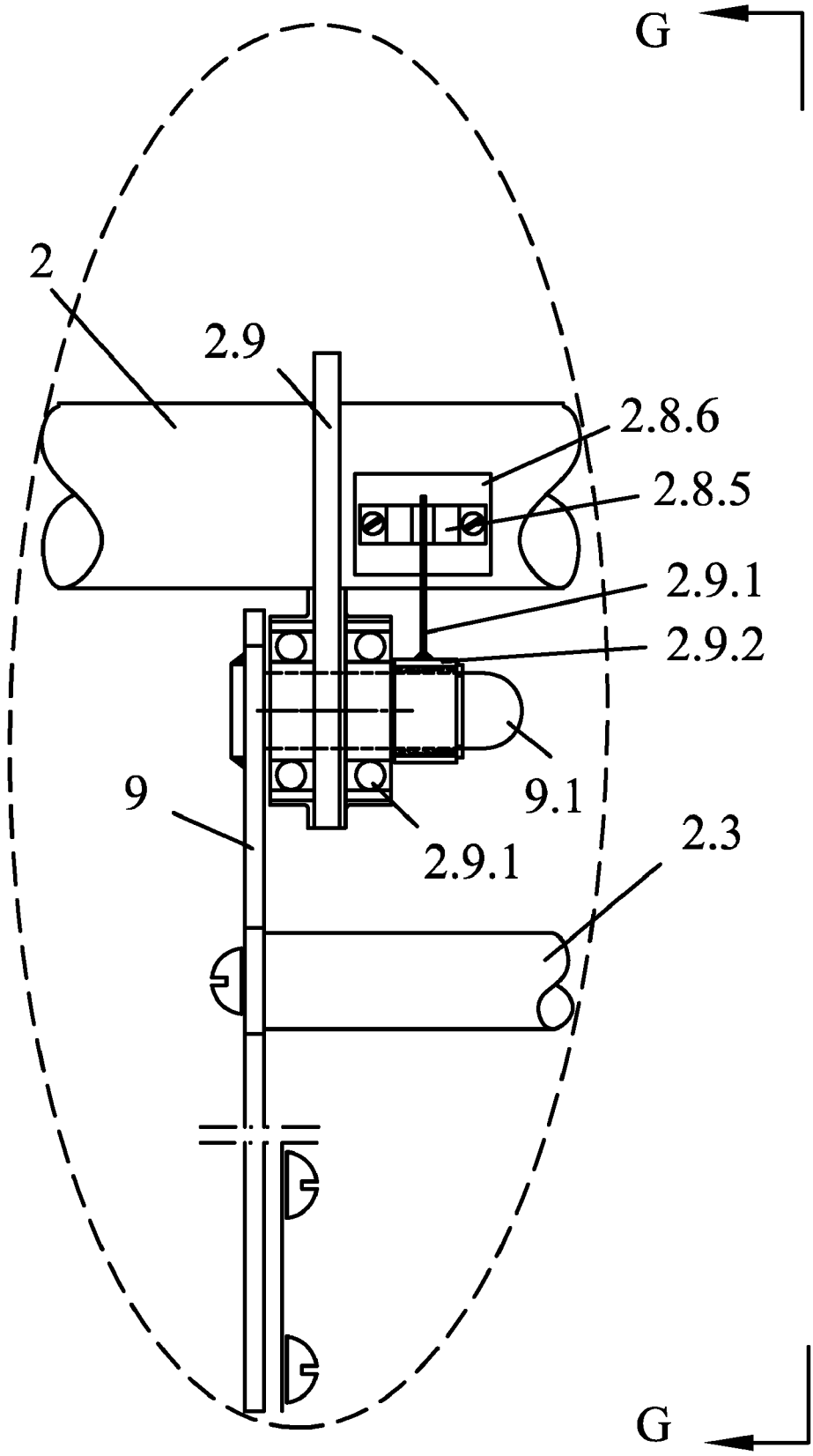
FIG. 12 is an enlarged view of section XII of the suspension device for an electric swing of FIG. 11 in accordance with another embodiment of the invention.
Figure 13:
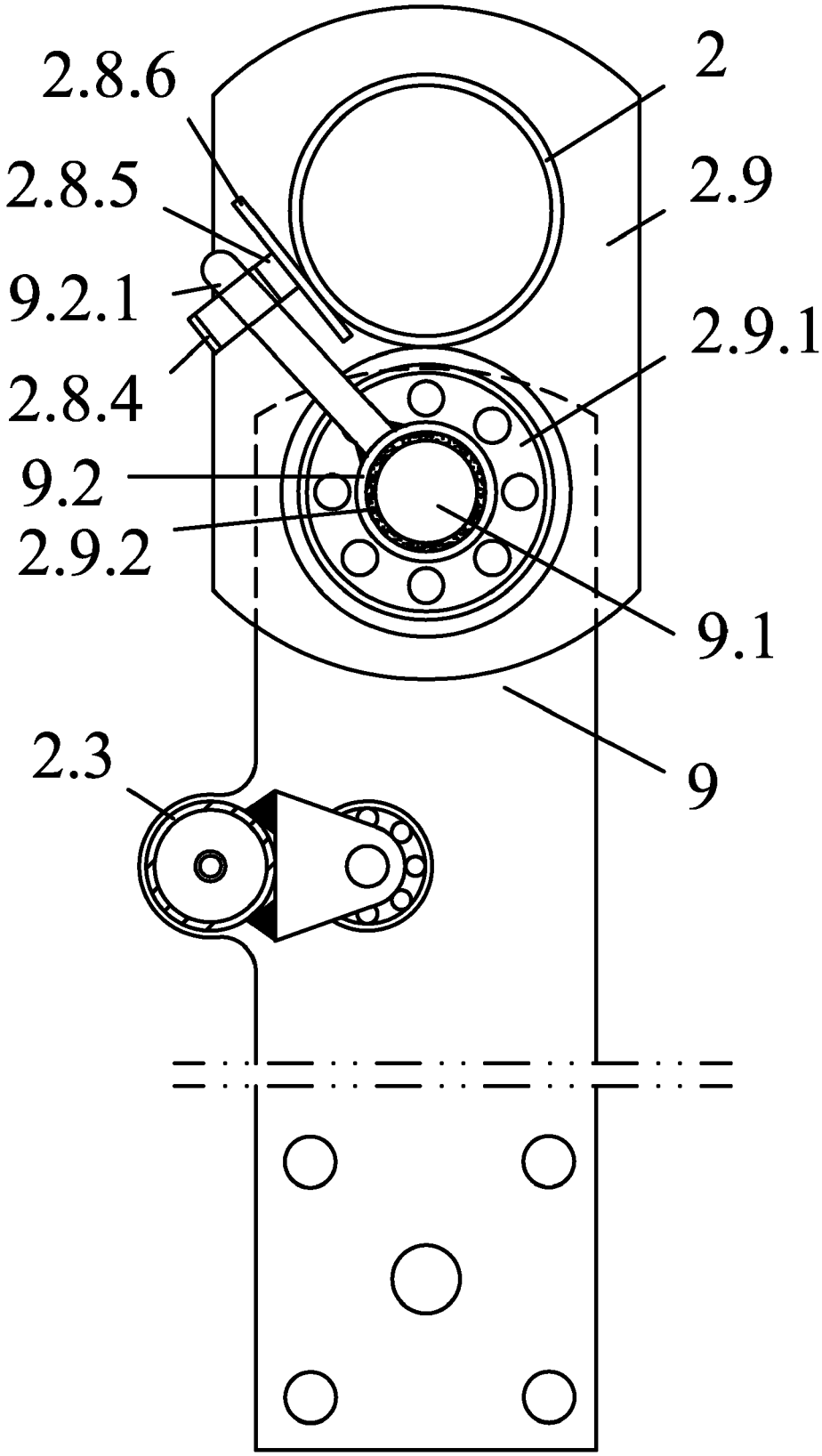
FIG. 13 is a sectional view of the suspension device for an electric swing of FIG. 12 taken from line G-G in accordance with another embodiment of the invention.

To further illustrate the invention, experiments detailing a suspension device for an electric swing and an electric swing equipped therewith are described below. It should be noted that the following examples are intended to describe and not to limit the invention.

EXAMPLE 1

As shown in FIGS. 1-10, a suspension device for an electric swing comprises a supporting bracket 1, a supporting beam 2, a suspended swing stem 2.2, a swing push rod 2.3, a gear motor 3, an electromagnetic clutch, a torque output plate 4.2, a direction switching pendulum weight 2.6, a swing direction monitor 2.8, a microcomputer controller 5, a housing 6, a safety switch 7, and a suspended body 8. The gear motor 3 is connected with a mounting plate 2.1 of the supporting beam using screws. The electromagnetic clutch comprises a disc-shaped armature 4.1 and a cylindrical electromagnetic clutch body 4.0. The output shaft of the gear motor 3 is connected with the disc-shaped armature 4.1 using screws. The electromagnetic clutch body 4.0 is closely against the armature 4.1. The ball bearing at the center of the electromagnetic clutch body 4.0 is fixedly connected with the shaft of the gear motor 3 and has the function of enabling the electromagnetic clutch body 4.0 to rotate relatively with the shaft of the gear motor and the armature when the electromagnetic clutch body is not powered. Two rigid pins 4.4 are fixedly arranged in the axial direction along the diameter of the armature at the back of the electromagnetic clutch body 4.0. The torque output plate 4.2 is a metal plate capable of bearing the output torque of the gear motor and a shaft 4.3 fixedly connected with the torque output plate is sheathed with an elastic rubber jacket, which provides a buffering effect and reduces the noise when to push the direction switching pendulum weight 2.6. A screw in the center of the torque output plate is loosely connected with the center of the shaft of the gear motor 3. The torque output plate has a width smaller than the distance (approx. ⅕-⅛) between the two rigid pins on the electromagnetic clutch body and has a length larger than the distance between the two rigid pins. The two rigid pins 4.4 on the electromagnetic clutch body are clamped at the two sides of the torque output plate 4.2 and each of the two rigid pins 4.4 is sheathed with an elastic rubber jacket, which provides a buffering effect and reduces the noise when the torque output plate 4.2 is pushed. The direction switching pendulum weight 2.6 is fixedly connected with the mounting plate 2.1 via a ball bearing seat 2.5. A ball bearing is arranged between the direction switching pendulum weight 2.6 and the ball bearing seat 2.5. The direction switching pendulum weight 2.6 is fixedly connected with a shaft 2.7 and the shaft 2.7 is sheathed with an elastic rubber jacket, which provides a buffering effect and reduces the noise when the swing push rod 2.3 is pushed. The ball bearing 2.2.1 of the suspended swing stem 2.2 is fixedly connected with the suspended swing stem 2.2 and the supporting beam 2, respectively. The lower end of the suspended swing stem 2.2 is connected with the suspended body 8 (e.g. a swing seat, a hammock or a cradle) using screws. At least two suspended swing stems 2.2 are mechanically connected with the swing push rod 2.3. The swing push rod 2.3 is fixedly connected with a bearing seat 2.4 at the position opposite to the direction switching pendulum weight 2.6 and the bearing seat 2.4 is mounted with a ball bearing or a rolling bearing. The swing direction monitor 2.8 comprises a rotating ring 2.8.0, a damping ring 2.8.1, a friction ring 2.8.2, a photoelectric shield 2.8.3, a shield baffle 2.8.4, and a photoelectric switch 2.8.5. The rotating ring 2.8.0 is fixedly connected with the outside of the ball bearing 2.2.1 on the suspended swing stem 2.2. A gap is formed between the rotating ring and the supporting beam 2. The external diameter of the rotating ring is sheathed with the damping ring 2.8.1, which is made of high polymer materials. The damping ring 2.8.1 is sheathed with the friction ring 2.8.2 and the photoelectric shield 2.8.3 is fixedly connected therewith. Within the turning radius of the photoelectric shield, the supporting beam is fixedly connected with the photoelectric switch 2.8.5 and a bracket 2.8.6 thereof. The shield baffle 2.8.4 is arranged at the openings of the transmitting and receiving members of the photoelectric switch. The photoelectric shield 2.8.3 is located in an enclosed space formed by the transmitting/receiving members of the photoelectric switch 2.8.5 and the shield baffle 2.8.4. The photoelectric shield 2.8.3 swings in a restricted space at the bottom of the shield baffle and the photoelectric switch is able to open and close the photoelectric switch. The safety switch 7 is mounted in the casing and can be touched when the swing range of the suspended swing stem exceeds its safety limit. When the swing range of the suspended swing stem 2.2 exceeds its safety limit, the suspended swing stem 2.2 will touch the safety switch 7, which sends signals to the microcomputer controller 5 and the microprocessor will then stop the drive for several swings to reduce the swing range. The microcomputer controller 5 comprises a microprocessor 5.1, a signal input port 5.2, a power input port 5.3, a wireless signal receiver module 523, and a time-controlled energy output port 54; the gear motor 3, the electromagnetic clutch, the photoelectric switch 2.8.5 and the safety switch 7 are electrically connected with the microcomputer controller 5. The signal input port 52 receives the control signals sent by the photoelectric switch drive signal 521, panel buttons 522 and the wireless signal receiver module 523 and then input them into the microprocessor 51. The microprocessor 51 will calculate the optimum time control based on the input data from the signal input port 52 and control On/Off of both the electromagnetic clutch and the gear motor 3 via the time-controlled energy output port 54.

The working principle of the suspension device for an electric swing is as follows: manually push the suspended body 8 to start the device; the suspended body 8 will drive the suspended swing stem 2.2, the rotating ring 2.8.0, the damping ring 2.8.1, the friction ring 2.8.2, and the photoelectric shield 2.8.3 to rotate together; when it rotates to a certain angle, the photoelectric shield 2.8.3 will be stopped by the shield baffle 2.8.4; since the stopping force is larger than the damping force and the friction force, the friction ring 2.8.2 will slide between the damping ring 2.8.1 and the rotating ring 2.8.0 and the photoelectric shield stops at the shield baffle 2.8.4. When the external force applied on the suspended body 8 exhausts, the potential energy accumulated in the suspended body 8 will drive it to swing backwards and meanwhile the suspended body 8 drives the suspended swing stem 2.2, the rotating ring 2.8.0, the damping ring 2.8.1, the friction ring 2.8.2, and the photoelectric shield 2.8.3 to swing backwards together; when they swing backwards to a certain angle, the photoelectric shield 2.8.3 will be stopped by the bottom of the photoelectric switch 2.8.5; since the stopping force is larger than the damping force and the friction force, the friction ring 2.8.2 will slide between the damping ring 2.8.1 and the rotating ring 2.8.0 and the photoelectric shield stops at the bottom of the photoelectric switch 2.8.5. The photoelectric shield 2.8.3 is arranged in an enclosed space between the transmitting/receiving members of the photoelectric switch 2.8.5 and the shield baffle 2.8.4. The photoelectric shield 2.8.3 swings in a restricted space at the bottom of the photoelectric shield and the photoelectric switch to control on-and-off of the photoelectric switch. The photoelectric shield 2.8.3 controls on-and-off of the photoelectric switch at the moment when the suspended body 8 switches from the forward swing to the back swing, so that the photoelectric switch 2.8.5 sends low/high-level signals to the microcomputer controller 5 to control on-and-off of the gear motor 3 and the electromagnetic clutch. When the microcomputer controller 5 turns on the power of the gear motor 3 and the electromagnetic clutch, the armature 4.1 of the electromagnetic clutch attaches to the electromagnetic clutch body 4.0 and the gear motor 3 drives the electromagnetic clutch body 4.0 to rotate; the two rigid pins 4.4 on the electromagnetic clutch body 4.0 are clamped at the two sides of the torque output plate 4.2 and drive the torque output plate 4.2 to rotate; a shaft 4.3 is fixedly connected with the point where the torque output plate 4.2 contacts with the direction switching pendulum weight 2.6, the torque output plate 4.2 rotates to enable the shaft 4.3 to push the direction switching pendulum weight 2.6 downwards and the direction switching pendulum weight 2.6 changes the rotation direction of the gear motor 3 to 90 degree; the direction switching pendulum weight 2.6 is fixedly connected with a shaft 2.7, the shaft 2.7 pushes the ball bearing of the swing push rod 2.3, the swing push rod 2.3 is connected with at least two suspended swing stems 2.2, the suspended body 8 is screw-connected with the suspended swing stem 2.2, the gear motor 3 outputs torque on the suspended body 8 to drive it to swing. When the microcomputer controller 5 turns on the power of the gear motor 3 and the electromagnetic clutch, its microprocessor starts to time; when the preset time length is reached, the microcomputer controller 5 will cut off the power of the gear motor 3 and the electromagnetic clutch, the motor will stop running and the electromagnetic clutch will detach from the armature, but the suspended body 8 still swings forwards under the inertia imposed by the gear motor 3. When the inertia on the suspended body 8 exhausts, the accumulated potential energy will enable the suspended body 8 to stop swinging forwards but swinging backwards; the swing push rod 2.3 pushes the direction switching pendulum weight 2.6 in a reversed direction, the direction switching pendulum weight 2.6 reversely pushes the torque output plate 4.2, which further reversely pushes the electromagnetic clutch to allow the electromagnetic clutch to loss power; the ball bearing at the center of the electromagnetic clutch body enables the electromagnetic clutch body to swing backwards relatively to the gear motor shaft and the armature 4.1. When the potential energy for the back swing exhausts, it will restart the previous process. The safety switch 7 restricts the maximum swing range of the suspended body; when the suspended swing stem touches the safety switch, the safety switch will send signals to the microcomputer controller 5, whose microprocessor will stop several swing drives to reduce the swing range.

EXAMPLE 2

As shown in FIGS. 9-13, a suspension device for an electric swing comprises a supporting bracket 1, a supporting beam 2, a suspended plate 2.9, a suspended swing stem 9, a swing push rod 2.3, a gear motor 3, an electromagnetic clutch, a torque output plate 4.2, a swing direction monitor 9.2, a safety switch 7, a suspended body 8, and a microcomputer controller 5. The suspended plate 2.9 is fixedly connected with the supporting beam 2. A ball bearing 2.9.1 mounted between the two bearing seats is fixedly connected with the suspended plate 2.9. One end of the suspended swing stem 9 is fixedly connected with a rotating shaft 9.1, which is sheathed on the ball bearing 2.9.1. The rotating shaft 9.1 is extended in the axial direction, and a damping ring 2.9.2 is sheathed on the extended portion of the rotating shaft 9.1. A friction ring 9.2 is sheathed on the damping ring 2.9.2. The friction ring 9.2 is fixedly connected with a photoelectric shield 9.2.1. Within the turning radius of the photoelectric shield, the supporting beam is fixedly connected with the photoelectric switch 2.8.5 and a bracket 2.8.6 thereof and a shield baffle 2.8.4 is arranged at the openings of the transmitting and receiving members of the photoelectric switch. The photoelectric shield 9.2.1 is located in an enclosed space formed by the transmitting/receiving members of the photoelectric switch 2.8.5 and the shield baffle 2.8.4. The photoelectric shield 9.2.1 swings in a restricted space between the shield baffle 2.8.4 and the bottom of the photoelectric switch to open and close the photoelectric switch. The difference between Example 1 and Example 2 is that the swing direction monitor is mounted in a different place.

The working principle of the suspension device for an electric swing is as follows: manually push the suspended body 8 to start it, the suspended body 8 will drive the suspended swing stem 9 and the rotating shaft 9.1 fixedly connected with one end of the suspended swing stem 9 to rotate together, the damping ring 2.9.2 produces the damping force to drive the friction ring 9.2 and the photoelectric shield 9.2.1 to rotate synchronously. The photoelectric shield 9.2.1 is located in an enclosed space formed by the transmitting/receiving members of the photoelectric switch 2.8.5 and the shield baffle 2.8.4. The photoelectric shield 9.2.1 swings in a restricted space between the shield baffle 2.8.4 and the bottom of the photoelectric switch to open and close the photoelectric switch. Consequently, the microcomputer controller 5 connects or cuts off the power output of the gear motor 3 and the electromagnetic clutch, thus enabling the suspended body 8 to swing in a continuous and controllable manner.

The microcomputer controller 5 may choose the preset power-on time for different gear via the panel buttons or a remote controller and the length of the power-on time depends on the swing range of the suspended body.

More than 80% swing time of the suspended body depends on inertia. The microcomputer controller 5 only needs to output a small amount of the electrical energy to compensate the friction resistance and the windage loss produced by the ball bearing 2.2.1 when the suspended body 8 swings, the suspended body can swing in a continuous manner with low energy consumption.

When the suspension device for an electric swing is not powered or the power is off, the electromagnetic clutch will automatically disengage from the gear motor, but the suspended body 8 still swings as usual, therefore manual operation of the clutch to the neutral position or to engage the gear is unnecessary.

Figure 14:
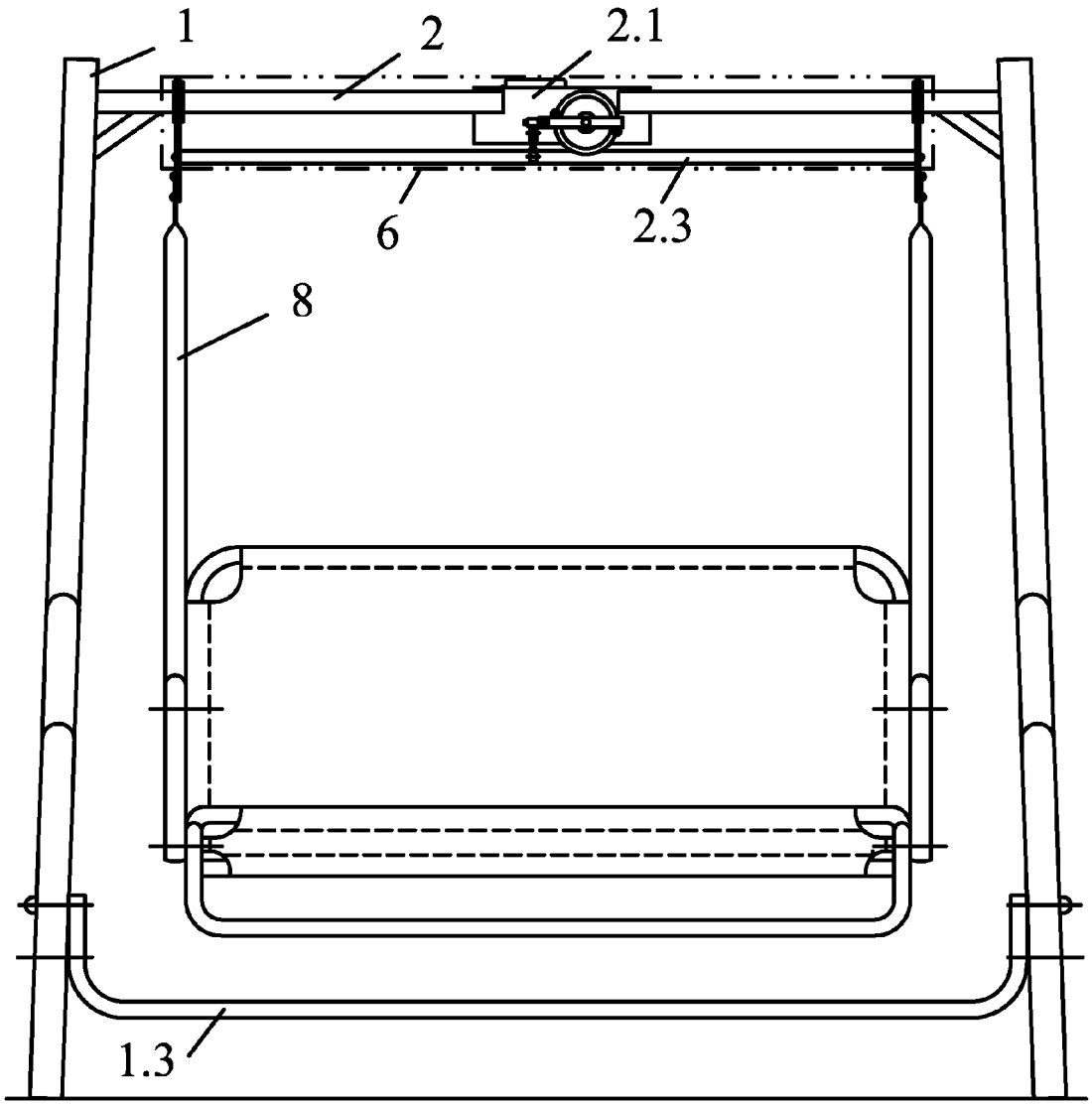
FIG. 14 is a front view of an electric swing equipped with a suspension device for an electric swing in accordance with one embodiment of the invention.
Figure 15:
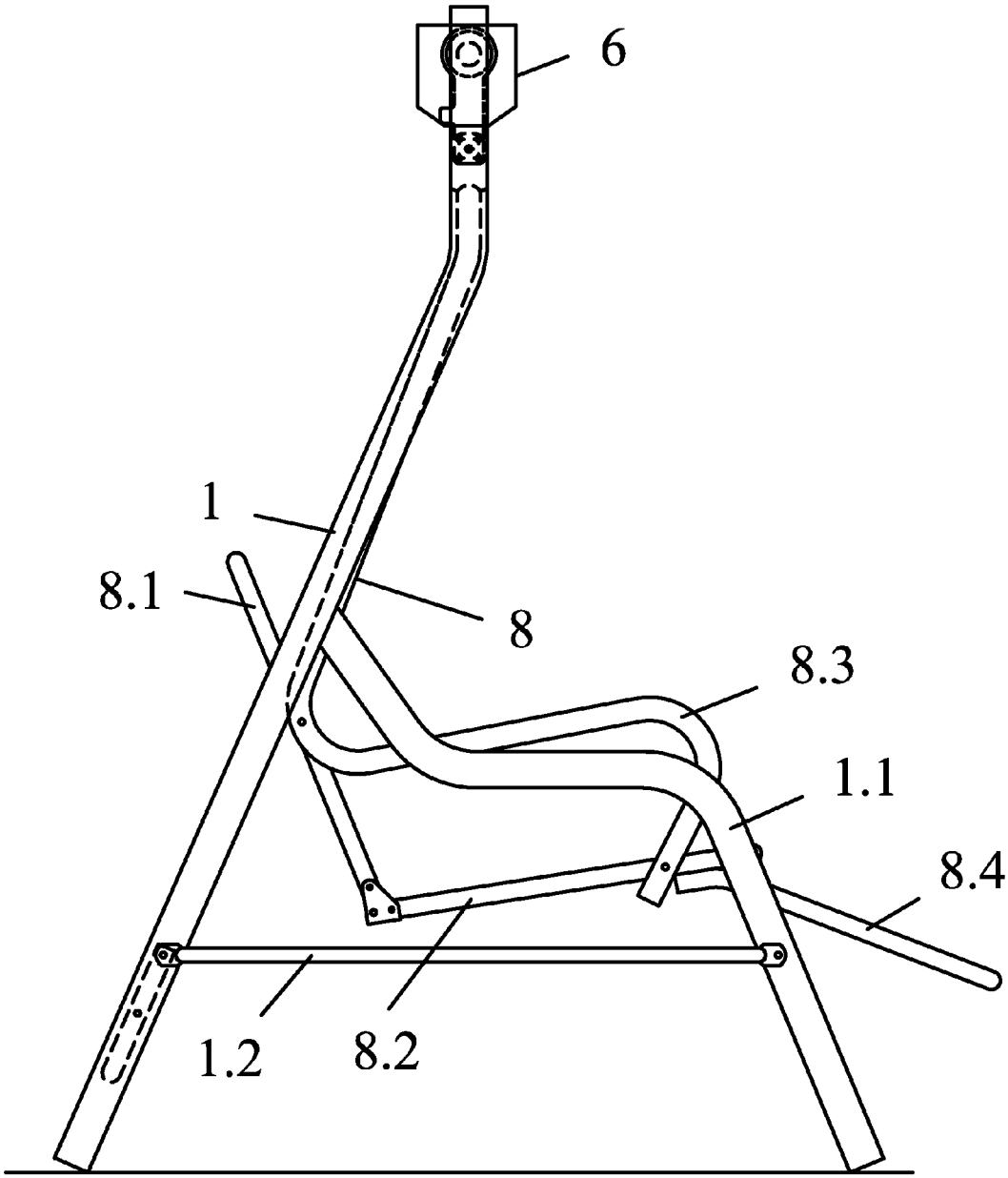
FIG. 15 is a left view of an electric swing equipped with a suspension device for an electric swing in accordance with one embodiment of the invention.

The invention further provides an electric swing, as shown in FIGS. 14 and 15, comprises a supporting bracket 1, a supporting beam 2, a housing 6, and a swing 8. The supporting bracket 1 takes the shape of "h" or "A" and comprises an upstanding column 1, a curved column 1.1, a longitudinal reinforced tube 1.2, and a transverse reinforced tube 1.3. The supporting beam 2 is fixedly connected with the supporting bracket 1. The central portion of the supporting beam 2 is arranged with a mounting plate 2.1 having a suspension device for an electric swing mounted thereon. A suspended swing stem is fixedly connected with the supporting beam 2 via a ball bearing. The swing 8 comprises a suspension rod, a backrest 8.1, a seat 8.2, armrests 8.3, and a foot pad 8.4, in which the suspension rod and armrests 8.3 are integrated together to connect the suspended swing stem, the backrest 8.1, and the seat 8.2. The foot pad 8.4 is fixedly mounted on the seat 8.2 for users to rest their feet.

The invention is not limited to the above detailed description and the embodiments. People who are skilled in the related art can easily produce the alternative embodiments or improvements based on the above detailed description. So, all of the alternative embodiments and improvements are in the scope of the claims of the invention. The device provided by the invention has the advantages of low costs, reliable and silent operation, compact structure and wide applications, and moreover it is energy saving and easy to carry.

INDUSTRIAL APPLICABILITY

The main components of the invention are the gear motor, the electromagnetic clutch, and the microcomputer controller, having the advantages of low costs, reliable and silent operation, compact structure and wide applications, and moreover they are energy saving and easy to carry, thus having good industrial applicability.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A suspension device for an electric swing, the suspension device comprising:

a) a supporting beam;
b) a supporting bracket;
c) a suspended body;
d) a suspended swing stem;
e) a gear motor;
f) an electromagnetic clutch;
g) a torque output plate;
h) a swing push rod;
i) a swing direction monitor;
j) a safety switch;
k) a microcomputer controller; and
l) a ball bearing;

wherein the supporting beam, the supporting bracket, and the suspended swing stem cooperate to bear the suspended body;

said ball bearing is fixedly connected with said suspended swing stem and said supporting beam;

the bottom of the suspended swing stem is mechanically connected with the suspended body;

the gear motor is mechanically connected with a mounting plate fixedly arranged on the supporting beam;

the electromagnetic clutch is mechanically connected with the gear motor;

the torque output plate is flexibly coupled with the electromagnetic clutch;

the direction switching pendulum weight is mechanically connected with the mounting plate;

the swing direction monitor is coupled with a bearing of the suspended swing stem or a shaft of the suspended swing stem;

the swing push rod is mechanically connected with at least two suspended swing stems;

the microcomputer controller is electrically connected with the swing direction monitor, the gear motor, and the electromagnetic clutch; and the microcomputer controller controls the turn on/off of a power supply of the gear motor and the electromagnetic clutch.

2. The electric suspension swing device according to claim 1, wherein the gear motor is a worm gear motor or a gear reducer motor.

3. The suspension device for an electric swing according to claim 2, wherein the electromagnetic clutch comprises a disc-shaped armature and a cylindrical electromagnetic clutch body;

the disc-shaped armature is fixedly connected with the gear motor;

the electromagnetic clutch body is closely against the armature and a ball bearing at the center of the electromagnetic clutch body is fixedly connected with a shaft of the gear motor;

the ball bearing at the center of the electromagnetic clutch body has the function of enabling the electromagnetic clutch body to rotate relatively with the shaft of the gear motor and the armature when the electromagnetic clutch body is not powered;

two rigid pins are fixedly arranged in the axial direction along the diameter edge of the electromagnetic clutch body in the opposite of the armature;

a central hole of the torque output plate is loosely connected with the shaft of the gear motor with bolts fixed to prevent the torque output plate from falling off;

the rigid pins are clamped at the two sides of the torque output plate; and the torque output plate transfers the torque of the gear motor to the direction switching pendulum weight.

4. The suspension device for an electric swing according to claim 1, wherein the electromagnetic clutch comprises a disc-shaped armature and a cylindrical electromagnetic clutch body;

the disc-shaped armature is fixedly connected with the gear motor;

the electromagnetic clutch body is closely against the armature and a ball bearing at the center of the electromagnetic clutch body is fixedly connected with a shaft of the gear motor;

the ball bearing at the center of the electromagnetic clutch body has the function of enabling the electromagnetic clutch body to rotate relatively with the shaft of the gear motor and the armature when the electromagnetic clutch body is not powered;

two rigid pins are fixedly arranged in the axial direction along the diameter edge of the electromagnetic clutch body in the opposite of the armature;

a central hole of the torque output plate is loosely connected with the shaft of the gear motor with bolts fixed to prevent the torque output plate from falling off;

the rigid pins are clamped at the two sides of the torque output plate; and the torque output plate transfers the torque of the gear motor to the direction switching pendulum weight.

5. The suspension device for an electric swing according to claim 1, wherein the direction switching pendulum weight is connected with a bearing seat via a ball bearing or a rolling bearing;

the bearing seat is fixedly mounted on the mounting plate;

the torque output plate pushes the direction switching pendulum weight; and the direction switching pendulum weight pushes the swing push rod.

6. The suspension device for an electric swing according to claim 5, wherein the swing push rod is fixedly connected with a ball bearing or a rolling bearing to reduce the mechanical friction produced when the direction switching pendulum weight pushes the swing push rod.

7. The suspension device for an electric swing according to claim 1, wherein the swing push rod is fixedly connected with a ball bearing or a rolling bearing to reduce the mechanical friction produced when the direction switching pendulum weight pushes the swing push rod.

8. The suspension device for an electric swing according to claim 1, wherein the swing direction monitor comprises a rotating ring, a damping ring, a friction ring, a photoelectric shield, a shield baffle, a photoelectric switch, and a bracket of the photoelectric switch;

the rotating ring is fixedly connected with the outer ring of the ball bearing on the suspended swing stem;

the external diameter of the rotating ring is sheathed with the damping ring;

the damping ring is sheathed with the friction ring having the photoelectric shield fixedly connected therewith;

within the turning radius of the photoelectric shield, the bracket of the photoelectric switch is fixed on the supporting beam, and the bracket is equipped with the photoelectric switch and the shield baffle;

the photoelectric shield works at an enclosed space formed between transmitting/receiving members of the photoelectric switch and the shield baffle; and the swing of the photoelectric shield controls the turn on/off of the photoelectric switch.

9. The electric suspension swing device according to claim 8, wherein the photoelectric switch of the swing direction monitor is replaced by a magnetic switch, a micro switch, or an inductive switch.

10. The suspension device for an electric swing according to claim 1, wherein the swing direction monitor comprises a damping ring, a friction ring, a photoelectric shield, a shield baffle, a photoelectric switch, and a bracket of the photoelectric switch;

the suspended swing stem has a rotating shaft sheathed with the damping ring;

the damping ring is sheathed with the friction ring having the photoelectric shield fixedly connected therewith;

within the turning radius of the photoelectric shield, the bracket of the photoelectric switch is fixed on the supporting beam, and the bracket is equipped with the photoelectric switch and the shield baffle;

the photoelectric shield works at an enclosed space formed between transmitting/receiving members of the photoelectric switch and the shield baffle; and the swing of the photoelectric shield controls the turn on/off of the photoelectric switch.

11. The electric suspension swing device according to claim 10, wherein the photoelectric switch of the swing direction monitor is replaced by a magnetic switch, a micro switch, or an inductive switch.

12. The suspension device for an electric swing according to claim 1, wherein the microcomputer controller is controlled by signals from the photoelectric switch, a remoter, or panel buttons to control the turn on/off of a power supply of the gear motor and the electromagnetic clutch.

13. An electric swing, comprising a suspension device for an electric swing of claim 1 and a swing seat; wherein the swing seat comprises a suspension rod, a backrest, a seat, armrests, and a foot pad; the suspension rod and the armrests are coupled with the suspended swing stem, the backrest, the seat, and the foot pad to form the swing seat.

14. A suspension device for an electric swing, the suspension device comprising:

a) a supporting beam;
b) a supporting bracket;
c) a suspended body;
d) a suspended swing stem;
e) a gear motor;
f) an electromagnetic clutch;
g) a torque output plate;
h) a swing push rod;
i) a swing direction monitor;
j) a safety switch;
k) a microcomputer controller;
l) a ball bearing; and
m) a suspended plate;

wherein the supporting beam, the supporting bracket, and the suspended swing stem cooperate to bear the suspended body;

said suspended plate is fixedly connected to said supporting beam;

said ball bearing is fixedly connected with said suspended plate and a rotating shaft;

said suspended swing stem is fixedly connected with said rotating shaft;

the bottom of the suspended swing stem is mechanically connected with the suspended body;

the gear motor is mechanically connected with a mounting plate fixedly arranged on the supporting beam;

the electromagnetic clutch is mechanically connected with the gear motor;

the torque output plate is flexibly coupled with the electromagnetic clutch;

the direction switching pendulum weight is mechanically connected with the mounting plate;

the swing direction monitor is coupled with a bearing of the suspended swing stem or a shaft of the suspended swing stem;

the swing push rod is mechanically connected with at least two suspended swing stems;

the microcomputer controller is electrically connected with the swing direction monitor, the gear motor, and the electromagnetic clutch; and the microcomputer controller controls the turn on/off of a power supply of the gear motor and the electromagnetic clutch.

* * * * *